US011819177B2

(12) United States Patent
Chirumbolo

(10) Patent No.: US 11,819,177 B2
(45) Date of Patent: Nov. 21, 2023

(54) RESETTABLE DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

(71) Applicant: ILLINOIS TOOL WORKS INC., Glenview, IL (US)

(72) Inventor: Dino Chirumbolo, Turin (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 482 days.

(21) Appl. No.: 16/802,910

(22) Filed: Feb. 27, 2020

(65) Prior Publication Data

US 2020/0281439 A1 Sep. 10, 2020

(30) Foreign Application Priority Data

Mar. 5, 2019 (IT) ..... 10 2019 000003155

(51) Int. Cl.
*A47L 15/42* (2006.01)
*E05B 15/02* (2006.01)
(Continued)

(52) U.S. Cl.
CPC ..... *A47L 15/4259* (2013.01); *E05B 15/0295* (2013.01); *E05B 2047/0068* (2013.01); *E05Y 2900/304* (2013.01)

(58) Field of Classification Search
CPC ..... A47L 15/4259; D06F 37/28; D06F 39/14; D06F 34/20; E05B 2047/0067;
(Continued)

(56) References Cited

U.S. PATENT DOCUMENTS 2,833,578 A 5/1958 Burke
3,506,292 A * 4/1970 Hagendoorn ..... E05C 19/024 292/216
(Continued)

FOREIGN PATENT DOCUMENTS

DE 1146781 B 4/1963
DE 10 2007 033 451 A1 1/2009
(Continued)

*Primary Examiner* — Christine M Mills
*Assistant Examiner* — Peter H Watson
(74) *Attorney, Agent, or Firm* — Pauley Erickson & Swanson

(57) ABSTRACT

A door locking device (1) including a support body (6) which can be fixed to a door (5) of an electric household appliance, a bracket (7) which can be fixed to a structural element (3) of the electric household appliance and a latching device (8) including: a locking tooth (10) constrained to rotate and translate relatively to the support body and which can be coupled with a first end thereof (12) with a transversal element (11) of the bracket; a sliding stem (13) cooperating with a second end (14) of the locking tooth by means of conjugated cam profiles (15, 16) carried by the locking tooth and by a head (17) of the stem; a compression spring (18) associated with the stem for thrusting the cam profiles (15, 16) into contact; and a tilting element (19) hinged to the support body to cooperate with the transversal element (11) of the bracket independently of the locking tooth, to activate a microswitch (23) when the tooth is in a locking position, wherein it engages the transversal element (11) of the bracket.

9 Claims, 8 Drawing Sheets

(51) Int. Cl.
*E05C 3/12* (2006.01)
*E05B 47/00* (2006.01)

(58) Field of Classification Search
CPC ..... E05B 2047/0068; E05B 15/0295; E05B 2015/0493; E05B 65/0046; E05C 3/12; E05C 3/124; E05C 3/16; E05C 3/22; E05C 3/24; E05C 3/26; E05C 3/30; E05C 3/38; E05C 3/40; E05C 2005/005; E05C 5/02; E05C 19/024; Y10T 292/0913; Y10T 292/0914; Y10T 292/0926; Y10T 292/0928; Y10T 292/0948; Y10T 292/1051; Y10T 292/1052; Y10T 292/1078; Y10T 292/0886; Y10T 292/0887; Y10T 292/702; Y10S 292/69
See application file for complete search history.

(56) References Cited

U.S. PATENT DOCUMENTS 6,913,296 B2 * 7/2005 Bassi ..... A47L 15/4259 292/122
2012/0126552 A1 * 5/2012 Ala ..... E05C 19/024 292/228
2013/0234578 A1 * 9/2013 Ala ..... E05B 15/0086 292/220
2014/0265378 A1 * 9/2014 Lee ..... E05C 19/024 292/341.17
2015/0267446 A1 * 9/2015 Promutico, I ..... E05C 19/02 292/122
2017/0211221 A1 * 7/2017 Uros ..... D06F 39/14

FOREIGN PATENT DOCUMENTS

DE 102011003818 A1 * 8/2012 ..... A47L 15/4259
EP 1 344 486 A2 9/2003
EP 1597998 A2 * 11/2005 ..... A47L 15/4259
EP 2471433 A1 * 7/2012 ..... A47L 15/4259
GB 879442 A * 7/1959 ..... E05B 65/0046
KR 20070078131 A * 7/2007 ..... A47L 15/4259
WO WO 2012/070023 A1 5/2012
WO WO 2014/039991 A1 3/2014

* cited by examiner

RESETTABLE DOOR LOCKING DEVICE FOR AN ELECTRIC HOUSEHOLD APPLIANCE, IN PARTICULAR A DISHWASHER, AND ELECTRIC HOUSEHOLD APPLIANCE PROVIDED THEREWITH

CROSS-REFERENCE TO RELATED APPLICATIONS

Italian Patent Application IT 102019000003155, filed 5 Mar. 2019 and PCT International Patent Application No. PCT/US2020/019926, filed 26 Feb. 2020, the priority documents corresponding to this invention, to which a foreign priority benefit is claimed under Title 35, United States Code, Section 119, and their entire teachings are incorporated, by reference, into this specification.

BACKGROUND OF THE INVENTION

Field of the Invention

This invention relates to a resettable door locking device for an electric household appliance in particular a dishwasher, and electric household appliance provided therewith. In particular, the invention relates to a door locking device that can be used even when one of its latching devices, for any reason, is incorrectly placed in the locking position already with the electric household appliance door still open.

Discussion of Related Art

EP1344486 is known for a door locking device of high simplicity and reduced size based on a rotating latching device combined with a bistable elastic mechanism which makes the latching device selectively assume two different stable positions, consisting respectively of a locking position, wherein the latching device engages, with the door closed, a hooking element, usually constituted by a U-shaped bracket, and in an unlocking position, wherein the latching device does not engage the hooking element.

It is also known, from DE 102007033451, a door locking device for a dishwasher wherein the hooking element, carried by the electric household appliance casing, is to be coupled with a revolving latching device carried by a support body, in turn in use, which can be positioned on the door of the electric household appliance.

However, many known devices, even when they are completely satisfactory, are generally bulky and those of a less modern conception are designed to be mounted with their bulkier part in the thickness of the electric household appliance door, this prevents the construction of electric household appliances with increased load capacity, which would be extremely useful, particularly in the dishwasher field, and the creation of thin doors.

In addition, in known door-locking devices, if the rotating latching device is accidentally positioned in the locking position when the electric household appliance door is still open, on the one hand it is impossible to lock the door correctly and, on the other hand, the microswitch signal of locked door, which cooperates directly with the rotating latching device or with an element associated with it, mistakenly provides a locked door signal to the electric household appliance, which can therefore be started with the consequent risk of fluid leakage to the outside.

Even if the user then detects the incorrect positioning of the rotating latching device, he/she should fit/reset it manually, making it rotate to the unlocked position. In order to do this, dedicated tools are indispensable, without which there is a risk for the user to get hands or fingers injured, albeit slightly.

SUMMARY OF THE INVENTION

It is an object of this invention to provide a door locking device for an electrical household appliance, in particular a dishwasher, which is constructively simple, of reduced cost and dimensions and of high reliability and which allows to overcome the drawbacks of the prior art, in particular that allows to report any abnormal positioning of the latching device and to fit/reset the device automatically, without a manual intervention by the user.

Therefore, this invention relates to a resettable door locking device for an electrical household appliance, in particular a dishwasher, and to an electrical household appliance equipped with such a device, as defined in the annexed claims.

BRIEF DESCRIPTION OF SEVERAL VIEWS OF THE DRAWINGS

Further characteristics and advantages of this invention will become clear from the description which is given below of a preferred embodiment, illustrated purely by way of non-limiting example and with reference to the attached drawings, wherein.

DESCRIPTION OF PREFERRED EMBODIMENTS

Figure 1:
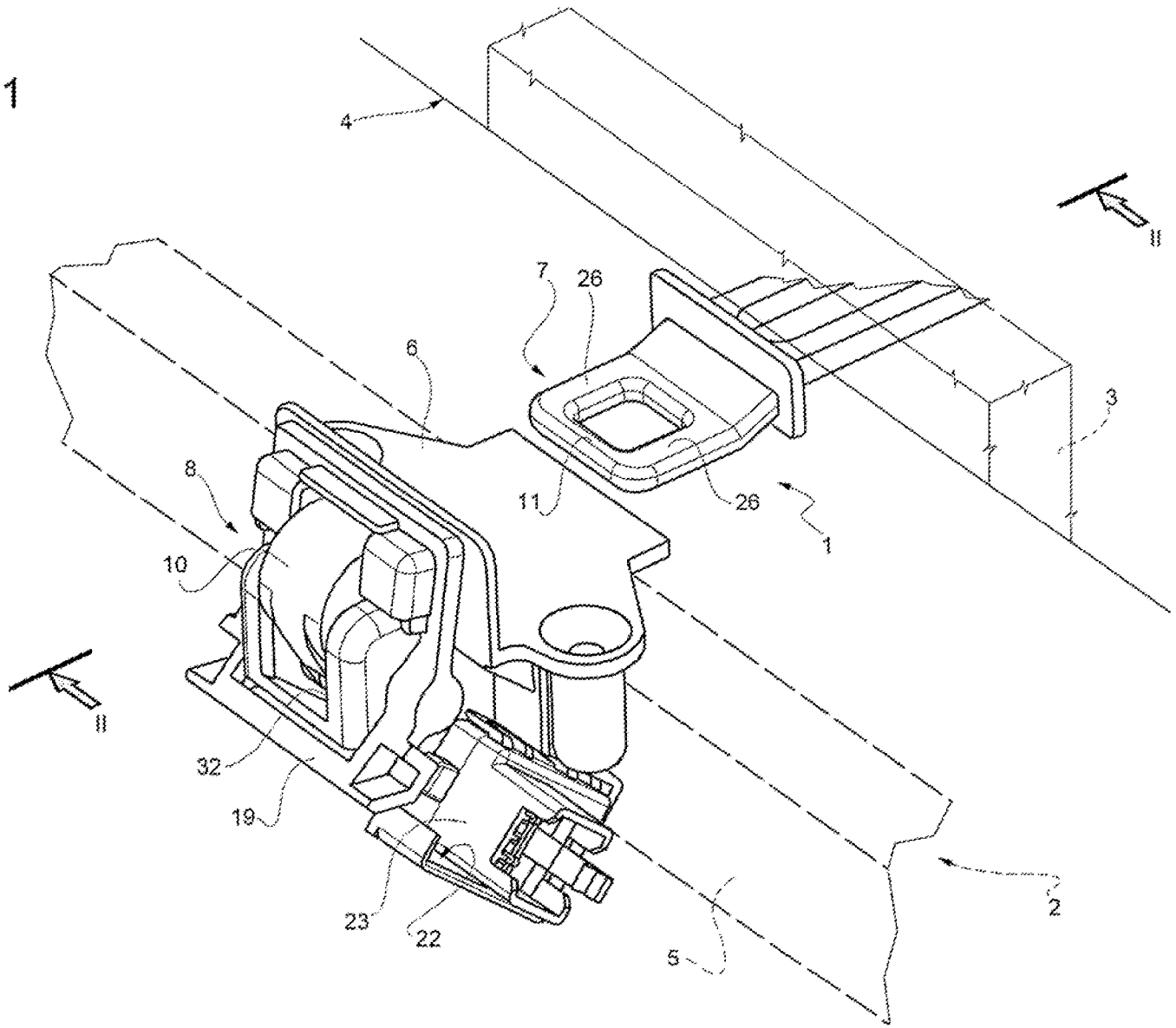
FIG. 1 illustrates schematically a three-quarter rear perspective view of a door locking device according to the invention applied on an electric household appliance, known and shown in broken lines only partly and only schematically for simplicity.

With reference to FIGS. 1 to 5 and FIGS. 9 and 10, 1 indicates as a whole a door locking device for an electric household appliance 2, in particular a dishwasher, of which the electric household appliance is illustrated for simplicity only part of a structural element 3, in this particular instance, a front upper crosspiece of a casing of the electric household appliance delimiting an upper edge of an access compartment to a washing chamber or tub 4 closed in use by a closing door 5.

Although the following non-limiting description refers to the case of a dishwasher with front door, it remains clear that the door locking device 1 according to the invention can be applied both to doors with horizontal rotation axis and to doors with vertical rotation axis. Therefore, the invention can also be used on drawer dishwasher machines.

The door locking device 1 comprises a support body 6 configured to be fixed in a known way to the door 5 of the electric household appliance 2, a bracket 7, for example U-shaped or frame-shaped, and configured to be fixed in a known way to the structural element 3 and a latching device 8 carried by the support body 6 and configured to cooperate in use with the bracket 7, in the manner that will be illustrated later.

The latching device 8 in turn comprises a locking tooth 10 carried by the support body 6 and constrained to the support body 6 so as to be able to rotate relatively thereto around a first A axis (FIGS. 2 and 9) and, at the same time, according to an aspect of the invention, so that the first A axis can, as will be illustrated later, translate relatively to the support body 6.

The locking tooth 10 comprises a first hook-shaped end 12, configured to couple with a transversal element 11 of the bracket 7 to lock in use, in a known way, the door 5 against the structural element 3 of the electric household appliance 1.

The latching device 8 further comprises a stem 13 carried by the support body 6 sliding along a symmetry B axis (FIG. 9) of the stem 13 itself and cooperating with a second end 14 of the locking tooth 10, opposite the end 12.

Furthermore, the end 14 is delimited by a first cam profile 15 which cooperates in contact with a second cam profile 16 obtained on a head 17 of the stem 13 facing the locking tooth 10.

In combination with the foregoing, the latching device 8 also includes, in addition to the stem 13 and the respective cam profiles 15, 16, a compression spring 18, in the non-limiting example illustrated a helical spring, operatively associated with the stem 13 and configured to thrust cam profiles 15 and 16 into contact with each other.

Here and below, by "compression spring" is intended an elastically deformable spring configured/mounted so as to be subjected, both at rest and during its operation, to only compression stresses.

According to an aspect of the invention, the latching device 8 finally comprises a frame-shaped tilting element 19, in the illustrated example configured as a substantially quadrangular frame, and hinged to the support body 6 so as to be able to rotate relatively thereto around a second C axis parallel to the first A axis; in addition, the tilting element 19 is configured to cooperate with the transversal element 11 of the bracket 7 regardless of the locking tooth 10.

In fact, the tilting element 19 is mounted externally on the support body 6 to which it is hinged around the C axis in a distal and independent position of the A axis and has opposite ends 20, 21 (FIG. 9) defined by crosspieces of the tilting frame element 19 which are parallel to the transversal element 11 of the bracket 7 and are arranged, respectively, the end 20 on the part of the end 12 of the tooth 10, adjacent thereto, and the end 21 on the part of the stem 13, adjacent to a seat 22 (FIG. 1) for a known microswitch 23 carried externally jointly and severally by the support body 6, preferably obtained integrally as a piece therewith.

Figure 2:
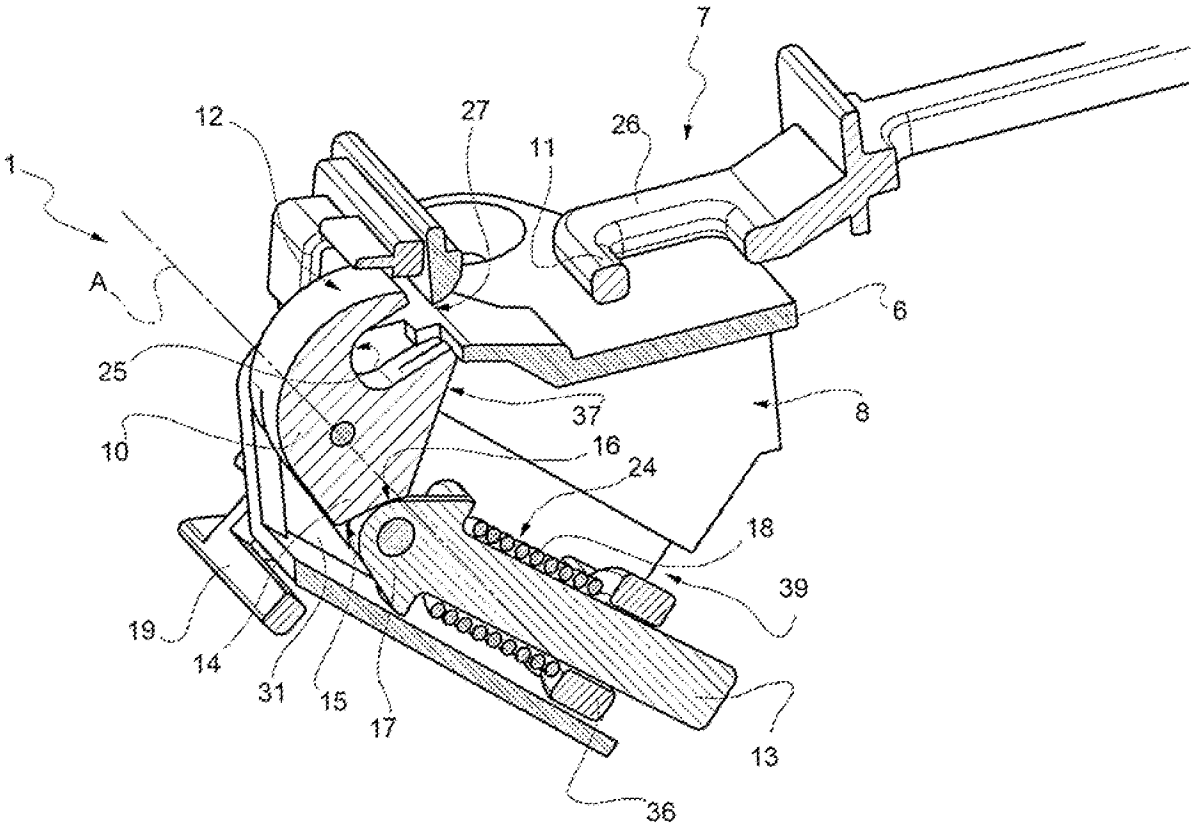
FIG. 2 illustrates schematically a three-quarter perspective view taken sideways and sectioned according to a plane II-II of the door locking device of FIG. 1 represented in a first operating position.
Figure 3:
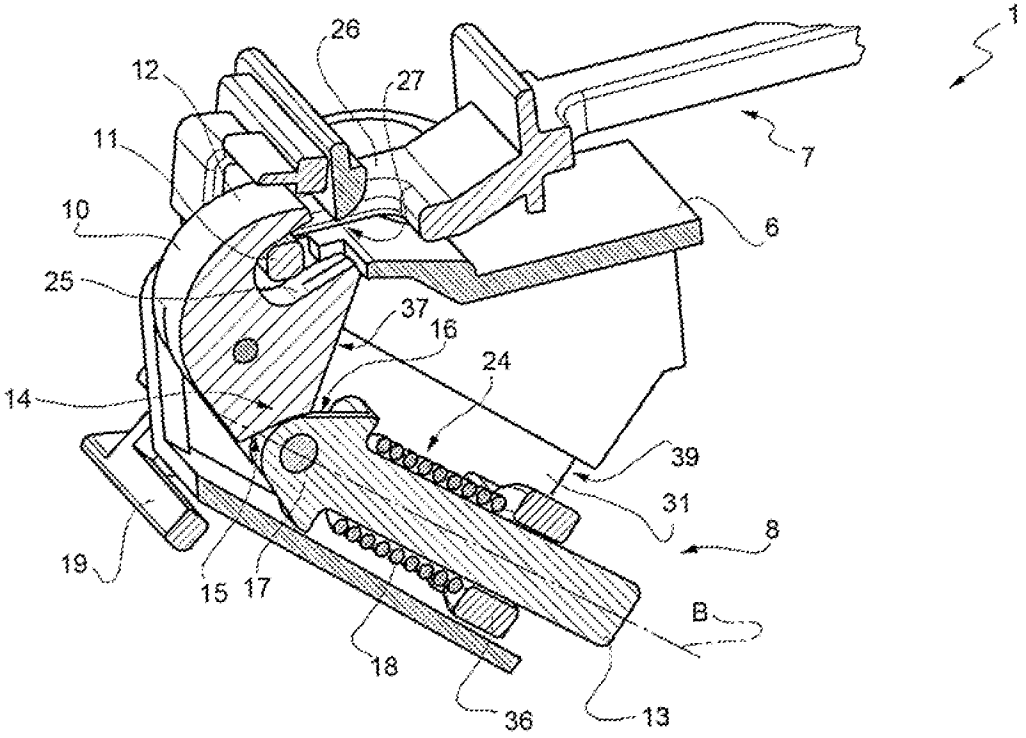
FIG. 3 illustrates schematically the same perspective and sectioned view of FIG. 2, with the door locking device of the invention represented in a second operating position.
Figure 5:
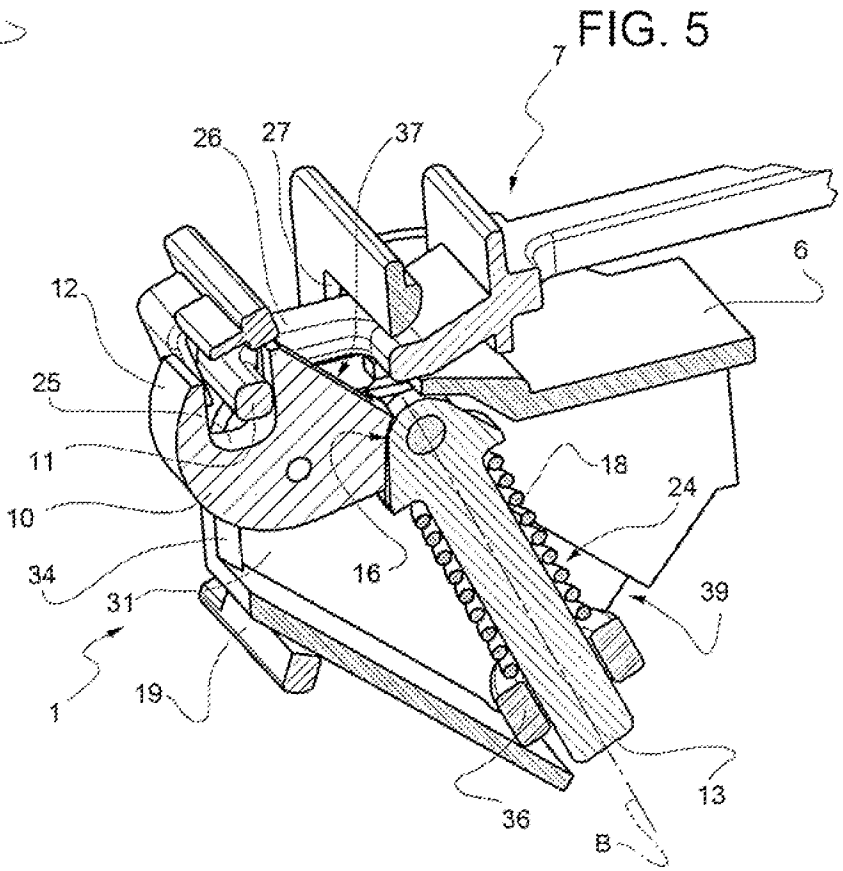
FIGS. 4 and 5 illustrate schematically the same perspective and sectioned view of FIG. 2, with the door locking device of the invention represented, respectively, in a third and fourth operating position.

According to an aspect of the invention, the cam profiles 15, 16 are configured to form, together with the locking tooth 10, the support body 6, to the stem 13 and to the compression spring 18, a bistable mechanism 24 (FIG. 2) adapted to selectively causing the locking tooth 10 to assume a receiving position, shown in FIGS. 2 and 3, and a locking position, shown in FIG. 5.

In the receiving position, a recess 25 obtained in the first end 12 of the locking tooth 10 is directed in parallel to respective longitudinal side members 26 of the bracket 7, perpendicular to the transversal element 11 of the bracket 7, to receive the transversal element 7 inside it.

Furthermore, the support body 6 has a reception slit 27 (FIG. 9) for the bracket 7, arranged facing the locking tooth 10 and configured to be crossed through, in use, by the bracket 7 on the side of the transversal element 11 thereof to reach the locking tooth 10.

In the receiving position, the tooth 10 has the recess 25 facing towards, and faces, the slit 27; the end 20 or crosspiece of the frame-shaped tilting element 19 also faces, and faces the, slit 27. The end 20 also has a central portion 29 shaped like a C (FIG. 9) which, in the receiving position of the tooth 10, is arranged astride the end 12 of the tooth 10 and flanks the recess 25 on opposite sides, facing the transversal element 11 of the bracket 7 together with the recess 25 thereof. The conformation of the tilting element 19 is in any case such as to avoid any interference and/or cooperation with the locking tooth 10.

In the locking position, instead, the recess 25 is directed transversely to the side members 26 of the bracket 7 and is arranged substantially perpendicular, or at least transversely, to the slit 27 (FIG. 5).

Preferably, the head 17 of the stem 13 is hinged to an arm 30, for example shaped like a fork (FIG. 9), which in the illustrated non-limiting example protrudes overhanging from the second end 14 of the locking tooth 10, perpendicular to the A axis, and which is obtained integrally in one piece with the end 14, so that the head 17 of the stem 13 rotates in use relatively to the arm 30 around a third D axis (FIG. 9), parallel to the first A axis. Obviously, the arm 30 could be missing or be integrated into the end 14 which in this case would preferably be fork-shaped. Other possible configurations, obvious to the person skilled in the art, are anyhow possible.

In the non-limiting but illustrated preferred example, the support body 6 comprises a hollow boxed portion 31 (FIG. 9) housing internally the stem 13, the compression spring 18 and the locking tooth 10, with the exception of the end 12 of the latter, which protrudes overhanging from the support body 6 through a slit 32 (FIGS. 1 and 9) of the boxed portion 31.

The first A axis is defined by a pair of profiled elements 33 (FIGS. 9 and 10) which protrude overhanging transversely from opposite sides of the locking tooth 10 and which are arranged between the ends 12 and 14 thereof.

The laterally protruded overhanging profiled elements 33 cooperate in contact with a radially internal perimeter edge 34 (FIG. 9) of the boxed portion 31 of the support body 6 and the compression spring 18 is configured to keep the laterally protruded overhanging profiled elements 33 of the locking tooth 10 permanently in contact with the radially internal perimeter edge 34 of the boxed portion 31 of the support body 6, so that the first A axis defined by the profiled elements 33 can translate relatively to the support body 6 along the profile of the perimeter edge 34.

In particular, the radially internal perimeter edge 34 of the boxed portion 31 of the support body 6 forms a loop 35

(FIGS. 6 and 7) configured to receive the laterally overhanging profiled elements 33 of the locking tooth 10 and within which the profiled elements 33 are normally kept by the compression spring 18, which is pre-loaded, so as to be free to rotate relatively to the support body 6 within the loop 35 between the aforementioned receiving and locking positions.

The lateral protruding overhanging profiled elements 33 of the locking tooth 10, instead of being simple pins, are also preferably shaped as rounded wedges or, anyhow, configured to cooperate selectively with respective portions of the radially internal perimeter edge 34 of the boxed portion 31 immediately adjacent, from opposite sides, to the loop 35, to act as end stops to determine the angular position of the receiving and locking positions of the locking tooth 10 with respect to the support body 6.

The stem 13 is engaged axially passing through a shoulder ring 36 (FIGS. 2 and 9) hinged to the support body 6 so that the shoulder ring 36 rotates relatively to the support body 6 around a fourth E axis (FIG. 9) parallel to the first A axis and preferably arranged coaxial to the second C axis. The compression spring 18 is inserted in a pack, pre-compressed, between the head 17 of the stem 13 and the shoulder ring 36, so that it constantly thrusts the head 17 against the end 14 of the tooth 10.

The recess 25 is configured to retain within it the transversal element 11 of the bracket 7 when the locking tooth 10 is in the locking position and when the recess 25 thereof has previously been engaged by the transversal element 11 of the bracket 7 with the locking tooth 10 in the receiving position (i.e. when the tooth 10 was previously in the receiving position).

Figure 6:
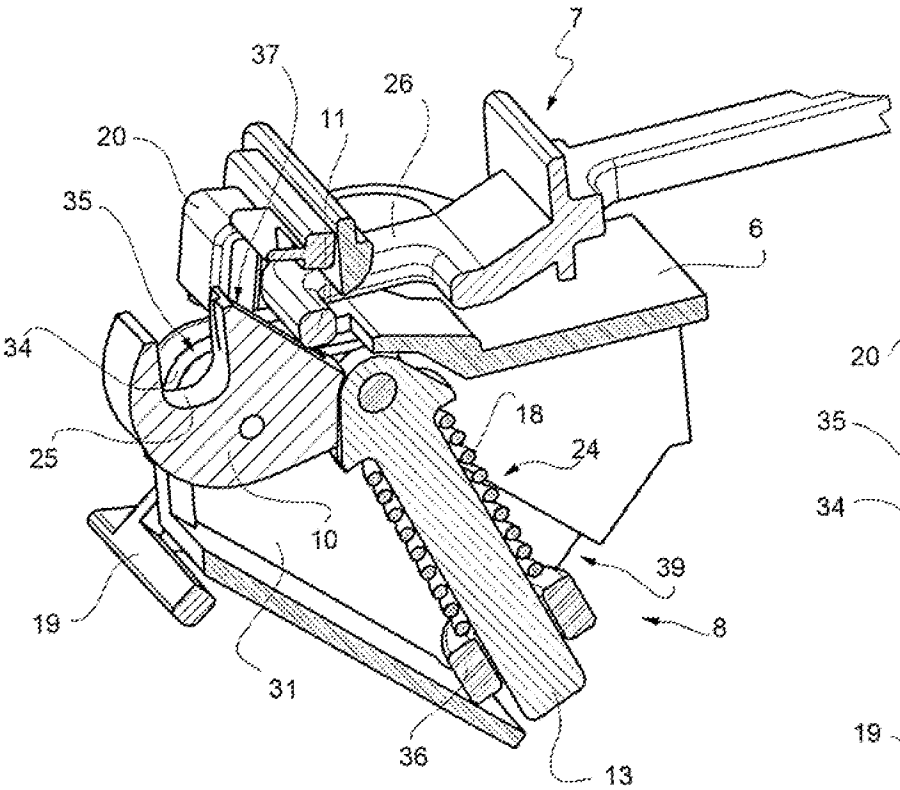
Figure 10:
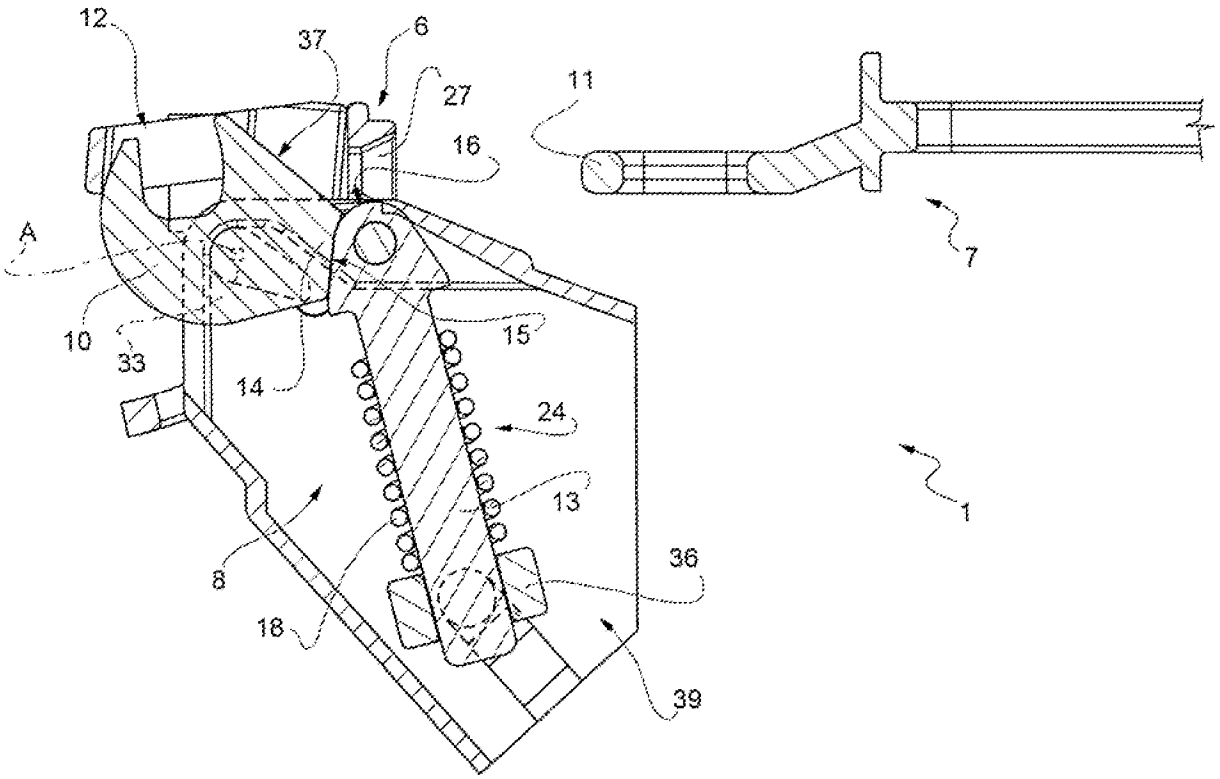
FIG. 10 illustrates an elevated and sectioned side view of the device of FIG. 1 in a configuration immediately preceding that illustrated in FIG. 6.

According to a further aspect of the invention, the locking tooth 10 is delimited, between the recess 25 and the second end 14 thereof, by a plane surface 37, obtained in a position immediately adjacent to the cam profile 15 and on the part of the recess 25. The plane surface 37 faces towards, or on the side of, the slit 27 of the support body 6 and, in the locking position, defines an inclined plane facing the slit 27 and configured to cooperate with the transversal element 11 of the bracket 7 if the recess 25, with the locking tooth in the locking position, had not already been engaged by the bracket 7 (FIGS. 6 and 10).

Figure 7:
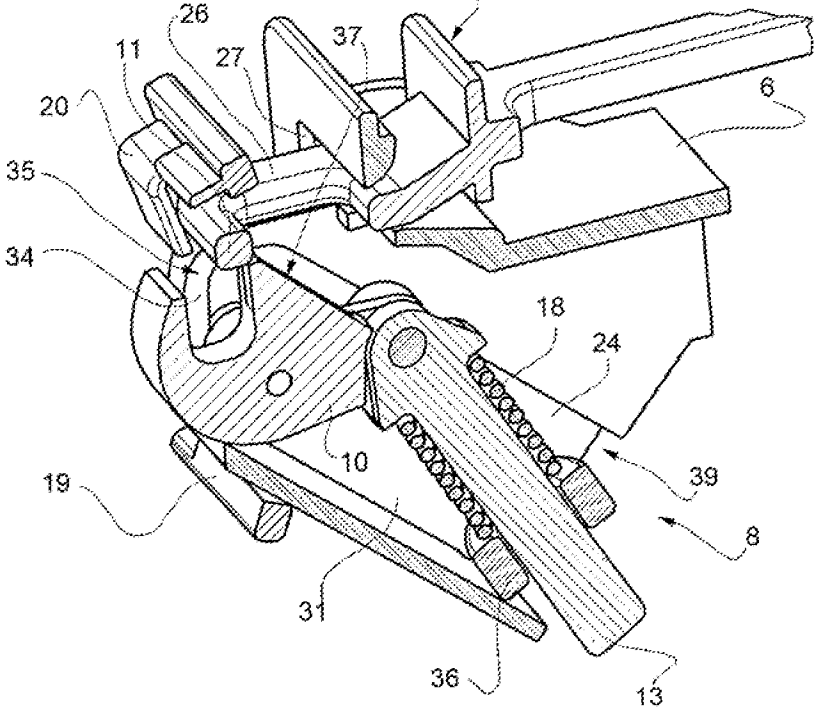
FIGS. 6, 7 and 8 illustrate schematically the same perspective and sectioned view of FIG. 2, with the door locking device of the invention represented in a sequence of operating positions that show its automatic fit/reset sequence.

This inclined plane defined by the surface 37 is configured to determine, as a consequence of a thrust exerted thereon by the transversal element 11 of the bracket 7, an axial thrust on the compression spring 18, through the stem 13, which thrusts the first A axis to move away from the slit 27 to allow the transversal element 11 of the bracket 7 to "jump" the locking tooth 10 and snap-fit with the recess 25 thereof (FIG. 7).

The operation of the described door locking device 1 is as follows.

With the door 5 open, the device 1 is in the configuration of FIGS. 1 and 2, wherein the tooth 10 is in the receiving position, which is one of the two stable positions allowed by the bistable mechanism 24. This position is stable, since the elastic thrust exerted by the spring 18 is discharged to the left (in the Figures) of the A axis, retaining the profiled elements 33 pressure supported inside/against the loop 35 (FIG. 2).

Figure 4:
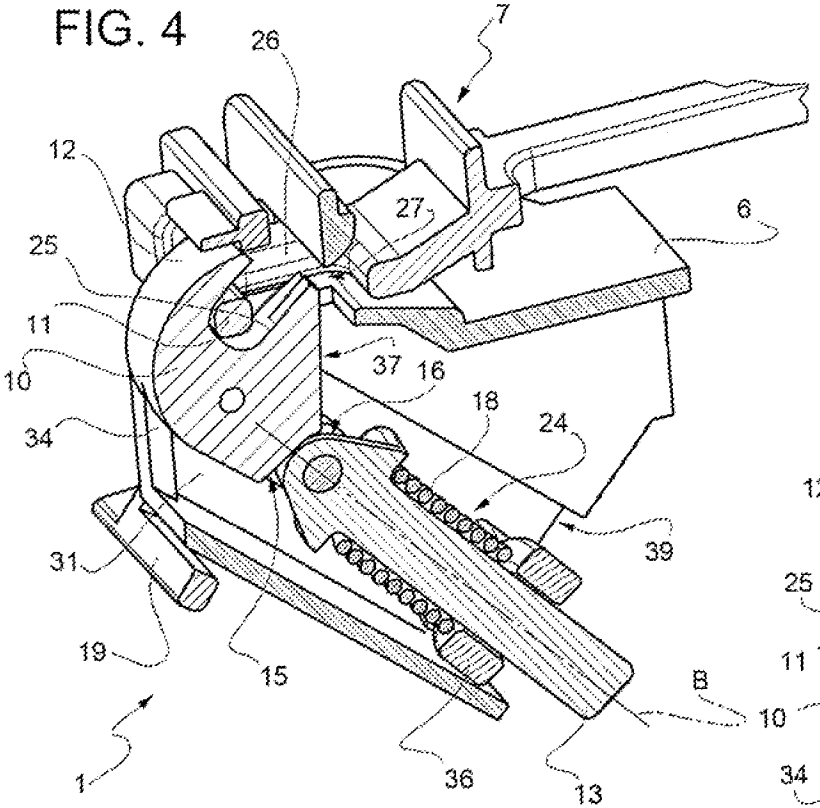

When the door 5 closes, the bracket 7 receives the slit 27, the transversal element 11 is supported against the end 12 of the tooth 10, up to inside the recess 25 (FIGS. 3 and 4). The thrust of the bracket 7 is eccentric with respect to the A axis and therefore forces the tooth 10 to rotate around the A axis, on the hinge defined by the loop 35 and the profiled elements 33; consequently also the end 14 rotates and the cam profiles 15, 16 rotate on the E axis the stem 13 and the shoulder ring 36, further compressing the spring 18 (FIGS. 4 and 5) until the B axis exceeds the alignment position of the A axis, defined by the loop 35, and the E axis, and moves to the right thereof in the Figures, triggering the mechanism 24 in a new stable position, bringing the tooth 10 into the locking position (FIG. 5).

In this position the recess 25 is rotated by about 90°, and therefore engages the transversal element 11 so that it can no longer be extracted through the slit 27. The elastic pre-load of the spring 18 also keeps the door 5 compressed in the closed position.

During the described movement, the tilting element 19 is also rotated by the thrust of the transversal element 11 on the C axis, bringing the end 21 against the microswitch 23, which is activated, signaling the status of closed and locked door.

In the opening phase, an opposite movement takes place; starting from the configuration in FIG. 5. The user, in this case, to open the door 5 must exert a pull on the door handle. The transversal element 11 which engages the recess 25 urges the end 12 to rotate towards the slit 27; the tooth 10 rotates on the A axis producing the compression of the spring 18 and the bistable mechanism 24 snaps towards the position of FIG. 3, passing through a configuration wherein, during the opening phase, the crosspiece 11 of the bracket 7 is placed next to the tooth adjacent to the inclined plane 37, while the profiled elements 33 remain engaged in the loop 35, due to the thrust of the spring 18, so that the A axis does not translate but the tooth 10 rotates around the A axis, which remains stationary. Once the position of FIG. 3 is reached, the bracket 7 can be extracted from the slit 27 and return to the starting position of FIGS. 1 and 2, with the door 5 open.

During these opening movements, the microswitch 23 is disconnected since the tilting element 19 is rotated in the inverted direction either by the thrust of the microswitch 23 thereof (which is internally equipped with a spring) or by a specially provided spring (not shown) for example on the C axis, following the backward movement of the transversal element 11 with the end 20 thereof.

With specific reference to FIGS. 6 to 8 and 10, the tooth 10 could accidentally find itself already in the locking position, while the door 5 is open (FIG. 10). In this case, the door locking device 1 is able to reset itself automatically without manual intervention by the user.

Firstly, the user is informed of the anomaly in the event that the door 5 is half-closed, but not locked, since even if the tooth 10 is in the locking position, the absence of the bracket 7 within the slit 27 does not cause the rotation of the tilting element 19 and therefore does not activate the microswitch 23.

Secondly, by thrusting the door 5 towards the closed position, the user thrusts the bracket 7 into the slit 27. The tooth 10 is in the locking position. This implies that the inclined plane defined by the plane surface 37 faces the slit 27 and therefore intercepts the transversal element 11 of the bracket 7, which begins to slide along the inclined plane 37 while the door 5 progressively approaches the closed position.

This movement involves an axial thrust against the stem 13 which compresses the spring 18, but the B axis remains to the left of the rotation A axis of the tooth 10.

Therefore, the tooth 10 is pushed to move away from the slit 27 descending into the boxed portion 31 through the slit 32, following a straight section 38 (FIG. 9) of the edge 34 against which the elements 33 are thrusted by the spring 18.

Figure 8:
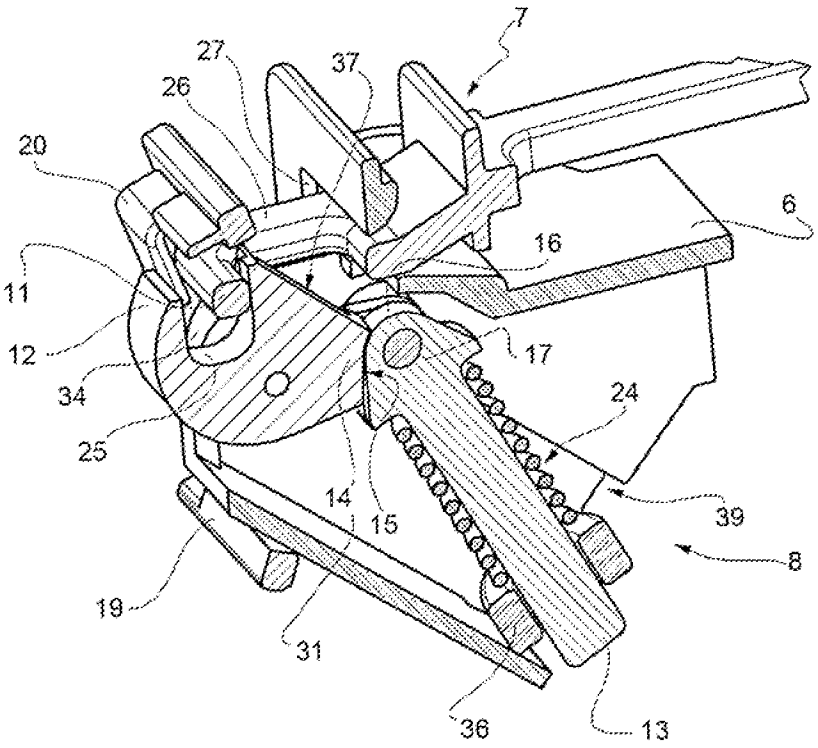
Figure 9:
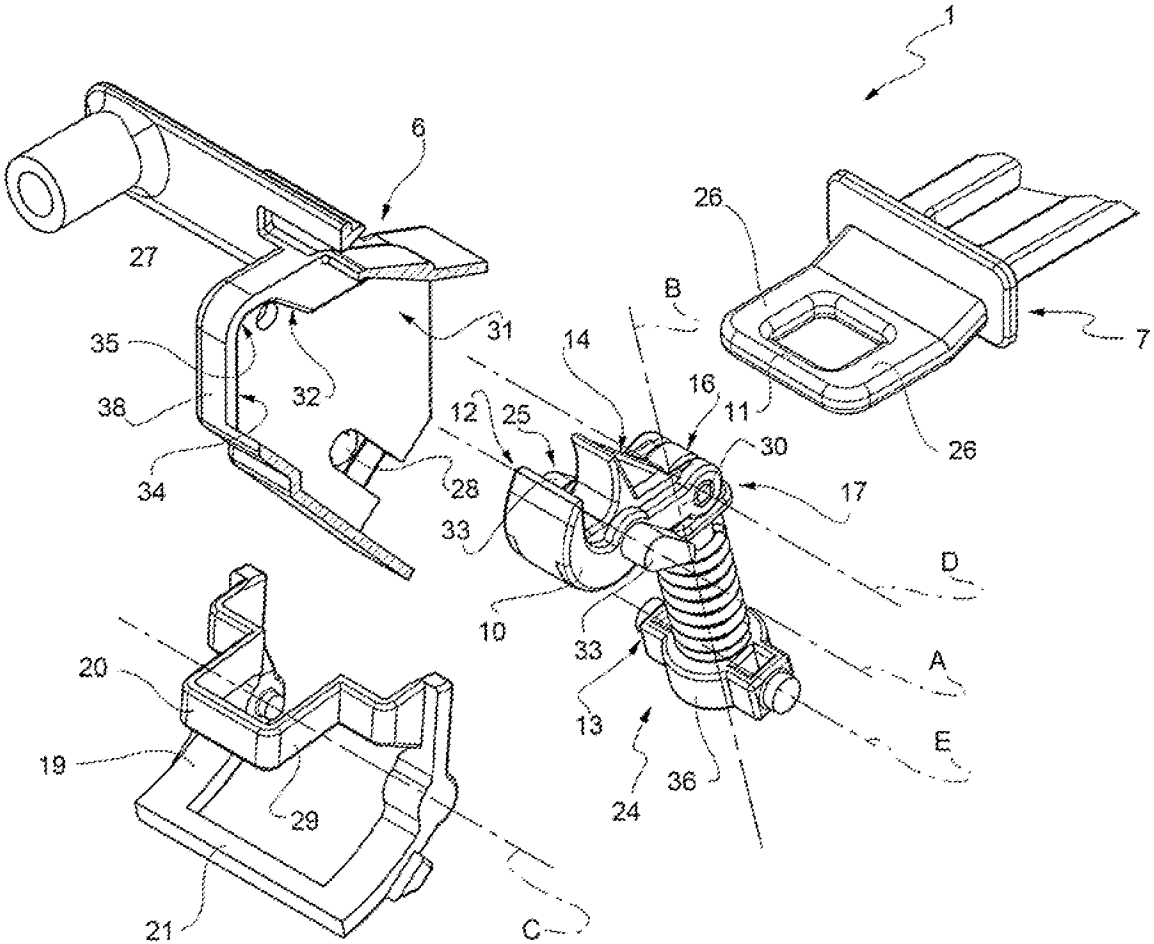
FIG. 9, illustrates a sectioned and exploded perspective view of the door locking device of the invention.

Consequently, the tooth 10 assumes sequentially the positions of FIGS. 6, 7 and 8, thanks to which the element 11 jumps the tooth 10 which is thrusted downwards and goes to engage the recess 25. As soon as this occurs, the thrust on the inclined plane 37 ceases and under the thrust of the spring 18 the tooth 10 rises again (FIG. 8) until it assumes the correct position of FIG. 5.

To mount the latching device 8 within the boxed portion 31 it is possible to obtain the support body 6 by means of a single block. Thanks to the elasticity of the thermoplastic material and the entrance 39, it is possible to snap-fit the shoulder ring 36 and the different components of the latching device 8 described within the boxed portion 31, in containment holes 28(6).

Through the containment holes 28, the shoulder ring 36 rotates relatively to the support body around a fourth E axis, passing through the center of the containment holes 28.

Finally, from what has been described it is clear that the invention also relates to an electric household appliance 2, in particular a dishwasher, comprising a structural element 3 delimiting an access compartment a washing chamber or tub 4 and a door 5 operatively associated with the access compartment and configured to assume an open position, wherein it allows access to the washing chamber or tub 4, and a closed position wherein it is locked against the structural element 3.

The electric household appliance 2 comprises a door locking device 1 as described having the support body 6 fixed jointly and severally to the door 5 in a known way, for example by means of screws not illustrated for simplicity, and the bracket 7 fixed jointly and severally to the structural element 3, also in a known way and not illustrated for simplicity.

The support body 6 has a lateral seat 22 housing a microswitch 23 and the frame-shaped tilting element 19 is configured to cooperate with the microswitch 23 only when the transversal element 11 of the bracket 7 engages the recess 25 of the locking tooth 10, thus warning the user in case of anomalies or in any case preventing the electric household appliance 2 from starting if the door 5 is not locked.

All the purposes of the invention are therefore achieved.

What is claimed:

1. A door locking device (1) for a door (5) of a household appliance (2) comprising:

a support body (6) designed to be secured to a door (5) of the household appliance, a lug (7) designed to be secured to a structural element (3) of the household appliance in a position facing, in use, the support body, and a latch device (8) borne by the support body (6) and configured to interact, in use, with the lug; wherein the latch device (8) comprises:

i) a blocking tooth (10) borne by the support body (6) and restrained to the support body such that the blocking tooth (10) can rotate relative to the support body (6) about a first axis (A) and the first axis (A) can move in translation relative to the support body (6), the blocking tooth comprising a first end (12) configured to be coupled with a transversal element (11) of the lug so as to lock the door against the structural element of the household appliance;

ii) a stem (13) borne by the support body sliding along an axis of symmetry (B) of the stem and interacting with a second end (14) of the blocking tooth, opposite to the first end;

iii) a first cam profile (15) formed on the second end (14) of the blocking tooth and a second cam profile (16) on a head (17) of the stem facing towards the blocking tooth;

iv) a compression spring (18) operationally associated with the stem and designed to push the second cam profile (16) into direct contact with the first cam profile (15);

v) a framed tilting element (19) hinged to the support body (6) such that it can rotate relative to the latter about a second axis (C) parallel to the first axis; the tilting element (19) being designed to interact with the transversal element (11) of the lug independently of the blocking tooth (10);

vi) the first and second cam profiles (15,16) being designed to form, together with the blocking tooth (10), the support body (6), the stem (13) and the compression spring (18), a bistable mechanism (24) that can cause the blocking tooth (10) to selectively take up a receiving position, in which a recess (25) made in the first end (12) of the blocking tooth is oriented parallel to respective longitudinal longerons (26) of the lug, perpendicular to the transversal element (11) of the lug, so as to receive the transversal element (11) of the lug, and a locking position, in which the recess (25) is orientated transversely to the longerons of the lug;

vii) wherein the stem (13) is inserted axially through a shoulder ring (36) hinged to the support body (6) by containment holes (28) in such a way that the shoulder ring rotates relative to the support body about a fourth axis (E) passing through a center of the containment holes (28), parallel to the first axis and generally coaxial with the second axis; the compression spring (18) being inserted packed between the head (17) of the stem and the shoulder ring (36); and viii) wherein the head (17) of the stem is hinged to an arm (30) which projects from the second end (14) of the blocking tooth, perpendicular to the first axis (A), and which is made integral in one piece with the second end of the blocking tooth, in such a way that the head (17) of the stem rotates relative to the arm about a third axis (D) parallel to the first axis.

2. The door locking device according to claim 1, wherein the support body (6) comprises an internally hollow box-shaped portion (31) housing the stem (13), the compression spring (18) and the blocking tooth (10), except for the first end (12) of the latter, which projects outwards from the support body through a slot (32) in the box-shaped portion; the first axis (A) being defined by a pair of profiled elements (33) that project transversely outwards on opposite sides of the blocking tooth (10) and that are arranged between the first and the second ends thereof; the laterally projecting profiled elements interacting in contact with a radially inner perimetral rim (34) of the box-shaped portion of the support body; the compression spring (18) configured to keep the laterally projecting profiled elements (33) of the blocking tooth permanently in contact against said radially inner perimetral rim (34) of the box-shaped portion of the support body, in such a way that the first axis (A) can move in translation relative to the support body along the perimetral rim (34).

3. The door locking device according to claim 2, wherein the radially inner perimetral rim (34) of the box-shaped portion of the support body forms a turn (35) designed to receive the laterally projecting profiled elements (33) of the blocking tooth and within which the laterally projecting profiled elements of the blocking tooth are normally held by the compression spring (18), so as to be free to rotate relative to the support body within the turn (35), between the receiving and locking positions.

4. The door locking device according to claim 3, wherein the laterally projecting profiled elements (33) of the blocking tooth are configured to interact selectively with respective stretches of the radially inner perimetral rim (34) of the box-shaped portion of the support body immediately adjacent, on opposite sides, to the turn (35), so as the laterally projecting profiled elements act as end-of-travel stops in order to determine the angular position of the receiving and locking positions of the blocking tooth (10) with respect to the support body (6).

5. The door locking device according to claim 1, wherein the recess (25) in the first end of the blocking tooth is configured to hold inside it the transversal element (11) of the lug when the blocking tooth (10) is in the locking position and when the transversal element (11) of the lug (7) has been previously engaged in the recess (25) in the receiving position of the blocking tooth.

6. The door locking device according to claim 1, wherein the support body (6) includes a slot (27) for receiving the lug (7), arranged facing the blocking tooth (10) and configured to be passed through, in use, by the lug, on the side of the transversal element (11) thereof, to reach the blocking tooth (10), which, in the receiving position, includes the recess (25) oriented towards the slot (27); the blocking tooth (10) being delimited, between the recess (25) and its second end (14), by a flat surface (37) which is oriented towards the slot (27) of the support body and which, in the locking position, defines an inclined plane facing the slot (27) and configured to interact with the transversal element (11) of the lug (7) in the event the lug, with the blocking tooth in the locking position, has already not been engaged in the recess.

7. The door locking device according to claim 6, wherein the inclined plane (37) is configured to determine, in response to a thrust exerted thereon by the transversal element (11) of the lug which is configured in a U-shape, an axial thrust on the compression spring (18), through the stem (13), which urges the first axis (A) to move away from the slot (27) so as to allow the transversal element of the lug to jump over the blocking tooth and snap-engage in the recess (25) thereof.

8. A household appliance (2) incorporating the door locking device (1) according to claim 1 comprising the structural element (3) defining an opening for accessing a washing tank or chamber (4) and a door (5) operationally associated with the access opening and designed to take up an open position, in which it allows access to the washing tank or chamber, and a closed position in which it is locked against the structural element; comprising:

the door locking device (1) having the support body (6) rigidly secured to the door (5) and the lug (7) rigidly secured to the structural element (3); the support body (6) having a lateral seat (22) housing a microswitch (23); the framed tilting element (19) being configured to interact with the microswitch (23) when the transversal element (11) of the lug (7) engages in the recess (25) of the blocking tooth.

9. A household appliance, comprising:

a structural element defining an access opening for accessing a washing tank or chamber;

a door operationally associated with the access opening and designed to take up an open position, in which it allows access to the washing tank or chamber, and a closed position in which it is locked against the structural element;

a door locking device including a support body secured to the door of the household appliance, a lug secured to the structural element of the household appliance in a position facing, in use, the support body, and a latch device borne by the support body and configured to interact, in use, with the lug; wherein the latch device comprises:

i) a blocking tooth borne by the support body and restrained to the support body such that the blocking tooth can rotate relative to the support body about a first axis and the first axis can move in translation relative to the support body, the blocking tooth comprising a first end configured to be coupled with a transversal element of the lug so as to lock the door against the structural element of the household appliance;

ii) a stem borne by the support body sliding along an axis of symmetry of the stem and interacting with a second end of the blocking tooth, opposite to the first end;

iii) a first cam profile formed on the second end of the blocking tooth and a second cam profile on a head of the stem facing towards the blocking tooth;

iv) a compression spring operationally associated with the stem and designed to push the second cam profile into direct contact with the first cam profile;

v) a framed tilting element hinged to the support body such that it can rotate relative to the latter about a second axis parallel to the first axis; the tilting element being designed to interact with the transversal element of the lug independently of the blocking tooth;

vi) the first and second cam profiles being designed to form, together with the blocking tooth, the support body, the stem and the compression spring, a bistable mechanism that can cause the blocking tooth to selectively take up a receiving position, in which a recess made in the first end of the blocking tooth is oriented parallel to respective longitudinal longerons of the lug, perpendicular to the transversal element of the lug, so as to receive the transversal element of the lug, and a locking position, in which the recess is orientated transversely to the longerons of the lug; and vii) wherein the stem is inserted axially through a shoulder ring hinged to the support body by containment holes in such a way that the shoulder ring rotates relative to the support body about a fourth axis passing through a center of the containment holes, parallel to the first axis and generally coaxial with the second axis; the compression spring being inserted packed between the head of the stem and the shoulder ring;

wherein the door locking device has the support body rigidly secured to the door and the lug rigidly secured to the structural element; the support body having a lateral seat housing a microswitch; and the framed tilting element being configured to interact with the microswitch when the transversal element of the lug engages in the recess of the blocking tooth.

* * * * *